US009865928B2

(12) United States Patent
Sudo et al.

(10) Patent No.: US 9,865,928 B2
(45) Date of Patent: Jan. 9, 2018

(54) DUAL-POLARIZED ANTENNA

(71) Applicant: Murata Manufacturing Co., Ltd., Kyoto (JP)

(72) Inventors: Kaoru Sudo, Kyoto (JP); Masayuki Nakajima, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/662,595

(22) Filed: Mar. 19, 2015

(65) Prior Publication Data

US 2015/0194730 A1 Jul. 9, 2015

Related U.S. Application Data

(63) Continuation of application No. PCT/JP2013/074521, filed on Sep. 11, 2013.

(30) Foreign Application Priority Data

Sep. 21, 2012 (JP) ..... 2012-208147

(51) Int. Cl.
*H01Q 1/38* (2006.01)
*H01Q 9/04* (2006.01)
*H01Q 5/378* (2015.01)

(52) U.S. Cl.
CPC ..... *H01Q 9/045* (2013.01); *H01Q 1/38* (2013.01); *H01Q 5/378* (2015.01)

(58) Field of Classification Search
CPC .... H01Q 9/0435; H01Q 9/0414; H01Q 13/08; H01Q 21/24; H01Q 5/378; H01Q 1/38; H01Q 9/045
See application file for complete search history.

(56) References Cited

U.S. PATENT DOCUMENTS 7,486,239 B1 * 2/2009 Channabasappa ... H01Q 9/0414 343/700 MS
2010/0171675 A1 * 7/2010 Borja ..... H01Q 1/38 343/798

(Continued)

FOREIGN PATENT DOCUMENTS

JP S55-093305 A 7/1980
JP S59-3042 A 1/1984

(Continued)

OTHER PUBLICATIONS

Notice of Reasons for Rejection issued in corresponding Japanese Patent Application No. 2014-536779 dated Nov. 10, 2015.

(Continued)

*Primary Examiner* — Graham Smith
*Assistant Examiner* — Noel Maldonado
(74) *Attorney, Agent, or Firm* — Pearne & Gordon LLP

(57) ABSTRACT

In a multilayer substrate (2), an internal ground layer (11) is provided at a position between insulating layers (4) and (5) and a radiating element (13) is provided at a position between insulating layers (3) and (4). A first coplanar line (7) is connected to an intermediate position of the radiating element (13) in an X-axis direction, and a second coplanar line (9) is connected to an intermediate position of the radiating element (13) in a Y-axis direction. A passive element (16) is laminated on the upper surface of the radiating element (13) through the insulating layer (3). The passive element (16) is formed in a cross shape in which a first patch (16A) extending in the X-axis direction and a second patch (16B) extending in the Y-axis direction are orthogonal to each other.

10 Claims, 11 Drawing Sheets

(56) References Cited

U.S. PATENT DOCUMENTS

| | | | | |
|---|---|---|---|---|
| 2011/0001682 | A1 | 1/2011 | Rao | |
| 2012/0212376 | A1* | 8/2012 | Jan | H01Q 9/0414 343/700 MS |

FOREIGN PATENT DOCUMENTS

| | | | |
|---|---|---|---|
| JP | S63-069301 | A | 3/1988 |
| JP | H05-129825 | A | 5/1993 |
| JP | H07-307613 | A | 11/1995 |
| JP | 2001-267833 | A | 9/2001 |
| JP | 2003-078338 | A | 3/2003 |
| JP | 2004-266499 | A | 9/2004 |
| JP | 2006-279785 | A | 10/2006 |
| JP | 2007-142876 | A | 6/2007 |

OTHER PUBLICATIONS

International Search Report issued in Application No. PCT/JP2013/074521 dated Dec. 17, 2013.
Translation of Written Opinion issued in Application No. PCT/JP2013/074521 dated Dec. 17, 2013.
Supplementary European Search Report issued in Application No. EP 13 83 8951 dated May 9, 2016.
Notice of Reasons for Rejection issued in Japanese Patent Appeal No. 2016-10047 dated Dec. 13, 2016.

* cited by examiner

DUAL-POLARIZED ANTENNA

FIELD OF THE INVENTION

The present invention relates to a dual-polarized antenna capable of being shared by two polarized waves, for example.

DESCRIPTION OF THE RELATED ART

Patent Document 1 discloses a microstrip antenna (patch antenna). In the microstrip antenna, a radiating element and a ground layer that are opposed to each other with a dielectric thinner than a wave length being interposed therebetween, for example, are provided and a passive element is provided at a radiant surface side of the radiating element. Further, Patent Documents 2 and 3 disclose dual-polarized antennas in which a radiating element is formed in a substantially square shape and feeding points are provided on axes orthogonal to each other. Patent Document 4 discloses a dual-polarized antenna in which power is fed to a patch antenna by a strip line formed in a cross shape. In addition, Patent Document 5 discloses a planar antenna for a single-direction polarized wave, which reduces a high-order mode by a patch antenna formed in a cross shape.

Patent Document 1: Japanese Unexamined Patent Application Publication No. 55-93305

Patent Document 2: Japanese Unexamined Patent Application Publication No. 63-69301

Patent Document 3: Japanese Unexamined Patent Application Publication No. 2004-266499

Patent Document 4: Japanese Unexamined Patent Application Publication No. 2007-142876

Patent Document 5: Japanese Unexamined Patent Application Publication No. 5-129825

BRIEF SUMMARY OF THE INVENTION

Each of the dual-polarized antennas as disclosed in Patent Documents 2 and 3 is a stack-type patch antenna including a passive element and can widen a bandwidth in comparison with a patch antenna without the passive element. However, each of the dual-polarized antennas as disclosed in Patent Documents 2 and 3 has a symmetry configuration with respect to two polarized-wave directions, so that the radiating element and the passive element are formed in substantially square shapes. Therefore, electromagnetic field coupling quantity between the radiating element and the passive element cannot be adjusted and widening of the bandwidth is limited.

The dual-polarized antenna as disclosed in Patent Document 4 is a single layer patch antenna and is not appropriate for widening the bandwidth. Further, the planar antenna as disclosed in Patent Document 4 is used for a single-direction polarized wave in the single layer and cannot be shared by two polarized waves.

The present invention has been made in view of the above-mentioned circumstances and an object thereof is to provide a dual-polarized antenna capable of enlarging a bandwidth.

(1) A dual-polarized antenna according to an aspect of the invention includes an internal ground layer, a radiating element laminated on an upper surface of the internal ground layer through an insulating layer, and a passive element laminated on an upper surface of the radiating element through an insulating layer, where the passive element is formed by intersection of a first patch and a second patch, and a first feeder line for feeding power to the radiating element in the direction corresponding to the first patch and a second feeder line for feeding power to the radiating element in the direction corresponding to the second patch are provided.

According to the aspect of the invention, the passive element is formed in the shape in which the first patch and the second patch intersect with each other and has a configuration in which the first feeder line for feeding power to the radiating element in the direction corresponding to the first patch and the second feeder line for feeding power to radiating element in the direction corresponding to the second patch are provided. Therefore, when an electric current flows through the radiating element by the power feeding through the first feeder line, a resonant frequency can be set based on the length dimension of the first patch parallel with the current and the electromagnetic field coupling quantity between the radiating element and the passive element can be adjusted based on the width dimension of the first patch orthogonal to the current. Likewise, when a current flows through the radiating element by the power feeding through the second feeder line, a resonant frequency can be set based on the length dimension of the second patch parallel with the current and the electromagnetic field coupling quantity between the radiating element and the passive element can be adjusted based on the width dimension of the second patch orthogonal to the current. Therefore, a bandwidth in which matching of the antenna can be ensured can be widened. In this case, the currents in the different directions flow through the radiating element by the first and second feeder lines, so that the length dimensions and the width dimensions of the intersecting first and second patches can be adjusted separately. As a result, the antenna capable of widening the bandwidth and being shared by two polarized waves can be configured.

(2) In the aspect of the invention, it is preferable that the passive element be formed in a cross shape in which the first patch and the second patch are orthogonal to each other.

According to the aspect of the invention, the passive element is formed in the cross shape in which the first patch and the second patch are orthogonal to each other. Therefore, the two polarized waves can be made orthogonal to each other, thereby enhancing radiation efficiency. Further, the radiating element, the passive element, and the like can be formed symmetrically in the directions orthogonal to each other. This makes it possible to form the antenna having symmetric directivity in comparison with the case where they are formed so as to be inclined obliquely.

(3) In the aspect of the invention, it is preferable that the first feeder line and the second feeder line be formed by microstrip lines, coplanar lines, or triplanar lines.

According to the aspect of the invention, the first feeder line and the second feeder line are formed by the microstrip lines, the coplanar lines, or the triplanar lines. Therefore, power can be fed to the radiating element using lines that are used commonly in a high-frequency circuit, thereby connecting the high-frequency circuit and the antenna easily.

(4) In the aspect of the invention, it is preferable that the first feeder line and the second feeder line be configured to extend in parallel with each other.

According to the aspect of the invention, the first feeder line and the second feeder line are configured to extend in parallel with each other. Therefore, the two feeding lines are made to extend toward the high-frequency circuit from the antenna in parallel, so that the antenna and the high-frequency circuit can be connected. This can connect the high-frequency circuit and the antenna easily in comparison with the case where the two feeding lines extend in the different directions.

DETAILED DESCRIPTION OF THE INVENTION

Figure 1:
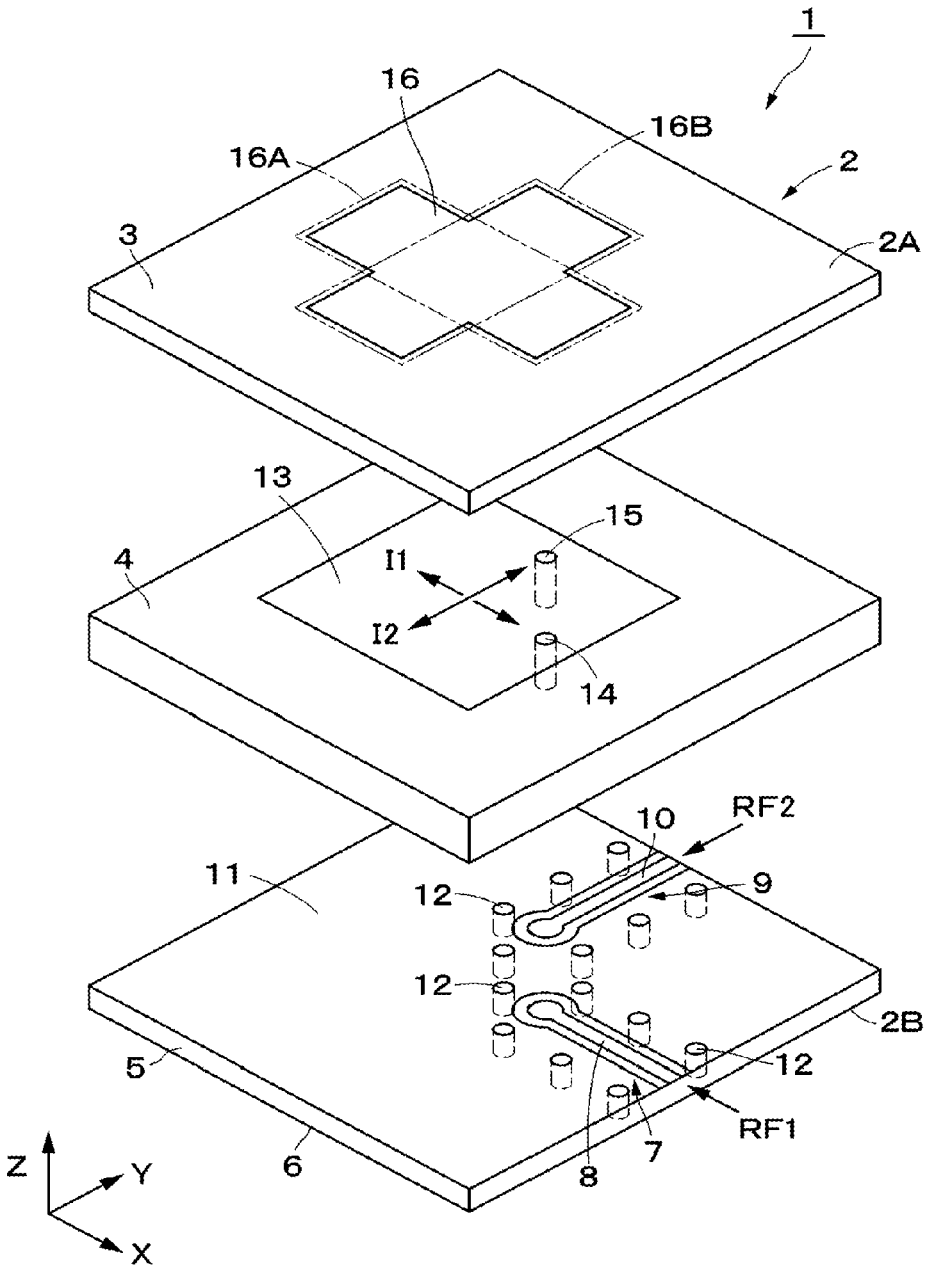
FIG. 1 is an exploded perspective view illustrating a dual-polarized antenna according to a first embodiment.

Hereinafter, dual-polarized antennas according to embodiments of the invention will be described in detail using a dual-polarized antenna for a band of 60 GHz, for example, with reference to the accompanying drawings.

FIG. 1 to FIG. 4 illustrate a dual-polarized antenna 1 according to a first embodiment. The dual-polarized antenna 1 is configured by a multilayer substrate 2, first and second coplanar lines 7 and 9, an internal ground layer 11, a radiating element 13, a passive element 16, and the like described later.

The multilayer substrate 2 is formed in a flat plate shape extending in two directions, for example, an X-axis direction and a Y-axis direction in parallel among the X-axis direction, the Y-axis direction, and a Z-axis direction orthogonal to one another. The multilayer substrate 2 has a length dimension of approximately several mm, for example, in the Y-axis direction, has a length dimension of approximately several mm, for example, in the X-axis direction, and has a thickness dimension of approximately several hundred μm, for example, in the Z-axis direction as a thickness direction.

The multilayer substrate 2 is formed by a low temperature co-fired ceramics multilayer substrate (LTCC multilayer substrate), for example, and includes three insulating layers 3 to 5 laminated in the Z-axis direction from the side of an upper surface 2A toward the side of a lower surface 2B. Each of the insulating layers 3 to 5 is made of an insulating ceramic material capable of being fired at a low temperature that is equal to or lower than 1000° C. and is formed in a thin film shape.

The multilayer substrate 2 is not limited to the ceramics multilayer substrate using the insulating ceramic material and may be formed by a resin multilayer substrate using an insulating resin material.

A lower-surface portion ground layer 6 is formed by a thin film made of a conductive metal such as copper, silver, or the like, for example, and is connected to the ground. The lower-surface portion ground layer 6 is located on the lower surface 2B of the multilayer substrate 2 and covers substantially the overall surface of the multilayer substrate 2.

Figure 2A:
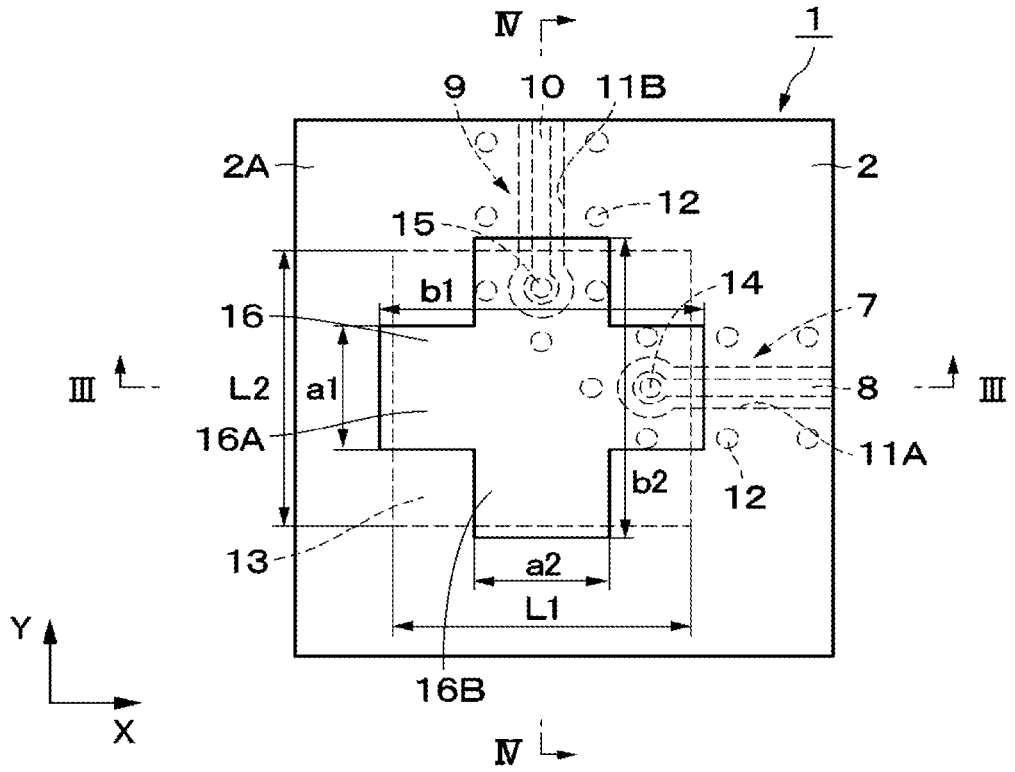
FIG. 2A is a plan view illustrating the dual-polarized antenna in FIG. 1

The first coplanar line 7 configures a feeding line for feeding power to the radiating element 13. As illustrated in FIG. 1 and FIG. 2A, the coplanar line 7 is configured by a strip conductor 8, as a conductor pattern provided between the insulating layer 4 and the insulating layer 5, and the internal ground layer 11, which will be described later, that is provided at both sides of the strip conductor 8 in the width direction (Y-axis direction). The strip conductor 8 is made of the conductive metal material that is the same as that of the lower-surface portion ground layer 6, for example, and is formed in an elongated band shape extending in the X-axis direction. Further, the leading end of the strip conductor 8 is connected to an intermediate position of the radiating element 13 between the center portion and a position of an end portion in the X-axis direction. The first coplanar line 7 transmits a first high-frequency signal RF1 and feeds power to the radiating element 13 such that a current I1 flows through the radiating element 13 in the X-axis direction corresponding to a first patch 16A, which will be described later.

The second coplanar line 9 configures a feeding line for feeding power to the radiating element 13. In the same manner as the first coplanar line 7, the second coplanar line 9 is configured by a strip conductor 10, as a conductor pattern provided between the insulating layer 4 and the insulating layer 5, and the internal ground layer 11, which will be described later, that is provided at both sides of the strip conductor 10 in the width direction (X-axis direction). The strip conductor 10 is made of the conductive metal material that is the same as that of the lower-surface portion ground layer 6, for example, and is formed in an elongated band shape extending in the Y-axis direction. Further, the leading end of the strip conductor 10 is connected to an intermediate position of the radiating element 13 between the center portion and a position of an end portion in the Y-axis direction. The second coplanar line 9 transmits a second high-frequency signal RF2 and feeds power to the radiating element 13 such that a current I2 flows through the radiating element 13 in the Y-axis direction corresponding to a second patch 16B, which will be described later.

The first high-frequency signal RF1 and the second high-frequency signal RF2 may have the same frequency or different frequencies.

The internal ground layer 11 is provided between the insulating layer 4 and the insulating layer 5. The internal ground layer 11 is formed by a thin film made of a conductive metal, for example. The internal ground layer 11 is opposed to the lower-surface portion ground layer 6 and is electrically connected to the lower-surface portion ground layer 6 with a plurality of vias 12, which will be described later. Therefore, the internal ground layer 11 is connected to the ground as in the lower-surface portion ground layer 6. In addition, vacant spaces 11A and 11B are provided in the internal ground layer 11 so as to surround the strip conductors 8 and 10. The vacant spaces 11A and 11B insulate the internal ground layer 11 and the strip conductors 8 and 10 from each other.

The vias 12 are formed as columnar conductors by providing a conductive metal material such as copper, silver, or the like, for example, on through holes having inner diameters of approximately several ten to several hundred μm, which penetrate through the insulating layer 5 of the multilayer substrate 2. The vias 12 extend in the Z-axis direction and both ends thereof are connected to the lower-surface portion ground layer 6 and the internal ground layer 11, respectively. The interval dimension between two adjacent vias 12 is set to a value smaller than a quarter of the wave length of the high-frequency signal RF1 or RF2 that is used, for example, in terms of the electric length. The plurality of vias 12 surround the vacant spaces 11A and 11B and are arranged along edge portions of the vacant spaces 11A and 11B.

For example, the radiating element 13 is formed in a substantially square shape using the conductive metal material that is the same as that of the internal ground layer 11, for example, and is opposed to the internal ground layer 11 with an interval therebetween. To be specific, the radiating element 13 is arranged between the insulating layer 3 and the insulating layer 4. In other words, the radiating element 13 is laminated on the upper surface of the internal ground layer 11 through the insulating layer 4. Therefore, the radiating element 13 is opposed to the internal ground layer 11 in a state of being insulated from the internal ground layer 11.

As illustrated in FIG. 2A, the radiating element 13 has a length dimension L1 of approximately several hundred μm to several mm, for example, in the X-axis direction and a length dimension L2 of approximately several hundred μm to several mm, for example, in the Y-axis direction. The length dimension L1 of the radiating element 13 in the X-axis direction is set to a value that is half the wave length of the first high-frequency signal RF1, for example, in terms of the electric length. On the other hand, the length dimension L2 of the radiating element 13 in the Y-axis direction is set to a value that is half the wave length of the second high-frequency signal RF2, for example, in terms of the electric length. Therefore, when the first high-frequency signal RF1 and the second high-frequency signal RF2 have the same frequency and the same band, the radiating element 13 is formed in a substantially square shape.

Further, a via 14, which will be described later, is connected to an intermediate position of the radiating element 13 in the X-axis direction and the first coplanar line 7 is connected to the radiating element 13 through the via 14. That is to say, an end portion of the strip conductor 8 is connected to the radiating element 13 through the via 14 as the connecting line. The current I1 flows through the radiating element 13 in the X-axis direction by power feeding through the first coplanar line 7.

On the other hand, a via 15 is connected to an intermediate position of the radiating element 13 in the Y-axis direction and the second coplanar line 9 is connected to the radiating element 13 through the via 15. That is to say, an end portion of the strip conductor 10 is connected to the radiating element 13 through the via 15 as the connecting line. The current I2 flows through the radiating element 13 in the Y-axis direction by power feeding through the second coplanar line 9.

The vias 14 and 15 are formed as columnar conductors in substantially the same manner as the vias 12. Further, the vias 14 and 15 are formed so as to penetrate through the insulating layer 4 and extend in the Z-axis direction, and both ends thereof are connected to the radiating element 13 and the strip conductors 8 and 10, respectively.

The via 14 configures a first connecting line connecting the radiating element 13 to the first coplanar line 7. The via 14 is connected to the intermediate position of the radiating element 13 between the center position and a position of the end portion in the X-axis direction. In this case, the via 14 is arranged at a position that does not oppose the patch 16B of the passive element 16 but is opposed to the patch 16A. That is to say, the via 14 is arranged at a position closer to an end portion of the patch 16A relative to the center portion thereof while avoiding the center portion on which the patches 16A and 16B of the passive element 16 overlap.

Moreover, the via 15 configures a second connecting line connecting the radiating element 13 to the second coplanar line 9. The via 15 is connected to the intermediate position of the radiating element 13 between the center position and a position of the end portion in the Y-axis direction. In this case, the via 15 is arranged at a position that does not oppose the patch 16A of the passive element 16 but is opposed to the patch 16B. That is to say, the via 15 is arranged at a position closer to an end portion of the patch 16B relative to the center portion thereof while avoiding the center portion on which the patches 16A and 16B of the passive element 16 overlap.

The passive element 16 is formed in a substantially cross shape using the conductive metal material same as that of the internal ground layer 11, for example. The passive element 16 is located at the opposite side to the internal ground layer 11 when seen from the radiating element 13 and is arranged on the upper surface 2A of the multilayer substrate 2 (the upper surface of the insulating layer 3). That is to say, the passive element 16 is laminated on the upper surface of the radiating element 13 through the insulating layer 3. Therefore, the passive element 16 is opposed to the radiating element 13 with an interval therebetween in a state of being insulated from the radiating element 13 and the internal ground layer 11.

Figure 2B:
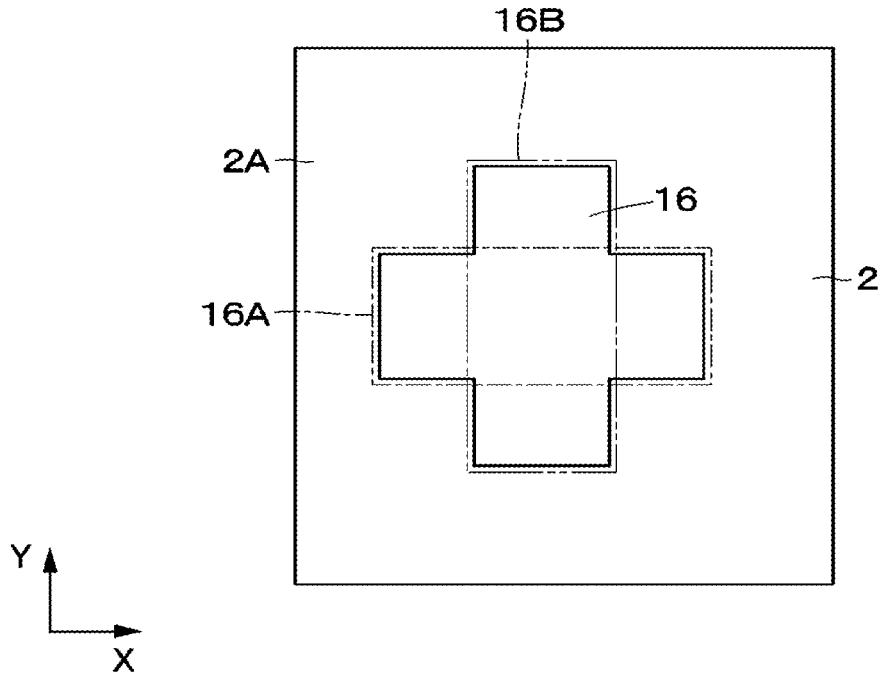
FIG. 2B is a plan view illustrating a passive element in FIG. 1.
Figure 3:
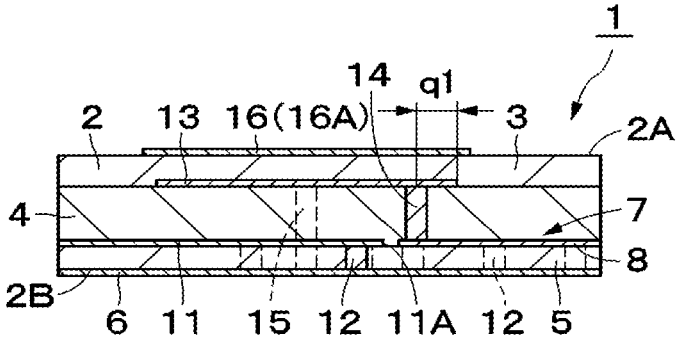
FIG. 3 is a cross-sectional view illustrating the dual-polarized antenna when seen from the direction of an arrow line III-III in FIG. 2A.
Figure 4:
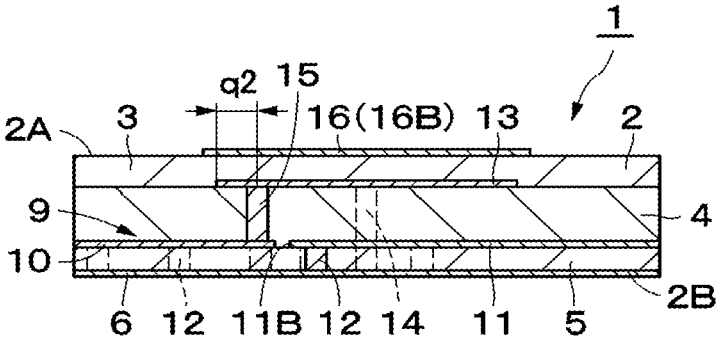
FIG. 4 is a cross-sectional view illustrating the dual-polarized antenna when seen from the direction of an arrow line IV-IV in FIG. 2A.

As illustrated in FIG. 2B, the two patches 16A and 16B of the passive element 16 intersect in a state of being orthogonal to each other. In this case, the first patch 16A extends in the X-axis direction and is formed in a substantially rectangular shape and the second patch 16B extends in the Y-axis direction and is formed in a substantially rectangular shape. The passive element 16 is integrally formed in a state where the center portions of the patches 16A and 16B overlap with each other.

The first patch 16A has a width dimension a1 of approximately several hundred μm, for example, in the Y-axis direction and has a length dimension b1 of approximately several hundred μm to several mm, for example, in the X-axis direction. Further, the second patch 16B has a width dimension a2 of approximately several hundred μm, for example, in the X-axis direction and has a length dimension b2 of approximately several hundred μm to several mm, for example, in the Y-axis direction.

When the radiating element 13 is excited by the power feeding through the first coplanar line 7, the first patch 16A and the radiating element 13 are electromagnetically coupled to each other. On the other hand, when the radiating element 13 is excited by the power feeding through the second coplanar line 9, the second patch 16B and the radiating element 13 are electromagnetically coupled to each other.

The width dimension a1 of the first patch 16A is smaller than the length dimension L2 of the radiating element 13, for example, and the length dimension b1 of the first patch 16A is larger than the length dimension L1 of the radiating element 13, for example. Likewise, the width dimension a2 of the second patch 16B is smaller than the length dimension L1 of the radiating element 13, for example, and the length dimension b2 of the second patch 16B is larger than the length dimension L2 of the radiating element 13, for example.

It should be noted that the size relation between the passive element 16 and the radiating element 13 and specific shapes thereof are not limited to the above-mentioned ones, and are appropriately set in consideration of a radiation pattern and the like of the dual-polarized antenna 1.

The dual-polarized antenna 1 according to the embodiment has the above-mentioned configuration, and operations thereof will be described next.

First, when power is fed to the radiating element 13 through the first coplanar line 7, the current I1 flows through the radiating element 13 in the X-axis direction. With this, the dual-polarized antenna 1 transmits or receives the first high-frequency signal RF1 in accordance with the length dimension L1 of the radiating element 13.

Figure 5:
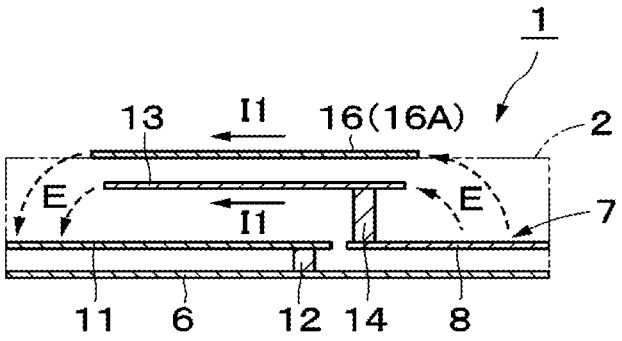
FIG. 5 is a descriptive view illustrating a resonant mode of the dual-polarized antenna at a position same as that in FIG. 3.
Figure 6:
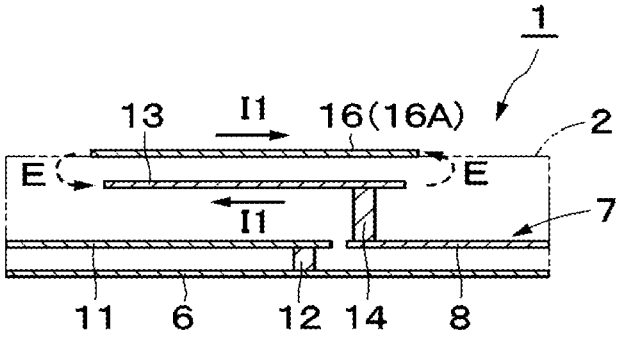
FIG. 6 is a descriptive view illustrating another resonant mode of the dual-polarized antenna at the position same as that in FIG. 3.

In this case, the radiating element 13 and the first patch 16A of the passive element 16 are electromagnetically coupled to each other and have two resonant modes having different resonant frequencies (see FIG. 5 and FIG. 6). The return loss of the high-frequency signal RF1 lowers at these two resonant frequencies and the return loss of the high-frequency signal RF1 also lowers in a frequency band between these two resonant frequencies. This widens the bandwidth of the first high-frequency signal RF1 which is capable of being used, in comparison with the case where the passive element 16 is omitted.

On the other hand, when power is fed to the radiating element 13 through the second coplanar line 9, the current I2 flows through the radiating element 13 in the Y-axis direction. With this, the dual-polarized antenna 1 transmits or receives the second high-frequency signal RF2 in accordance with the length dimension L2 of the radiating element 13.

In this case, the radiating element 13 and the second patch 16B of the passive element 16 are electromagnetically coupled to each other and have two resonant modes having different resonant frequencies in the same manner as described above. This widens the bandwidth of the second high-frequency signal RF2 which is capable of being used, in comparison with the case where the passive element 16 is omitted.

When the square passive element is used as in Patent Documents 2 and 3, two resonant frequencies between the passive element and the radiating element for the first high-frequency signal are determined based on the length dimension of the passive element in the X-axis direction. Further, two resonant frequencies between the passive element and the radiating element for the second high-frequency signal are determined based on the length dimension of the passive element in the Y-axis direction. Therefore, when coupling quantity between the passive element and the radiating element is adjusted by changing the shape of the passive element, the resonant frequencies also change, which raises a problem that it is difficult to adjust the coupling quantity separately from the resonant frequencies.

In contrast, in the embodiment, the passive element 16 is formed in the cross shape in which the two patches 16A and 16B intersect with each other. Therefore, the resonant frequencies can be set based on the length dimensions b1 and b2 of the patches 16A and 16B, and the coupling quantity can be adjusted based on the width dimensions a1 and a2 of the patches 16A and 16B. Therefore, the coupling quantity between the radiating element 13 and the passive element 16 can be adjusted for the first and second high-frequency signals RF1 and RF2 separately from the resonant frequencies, thereby enlarging the bandwidth.

Figure 7:
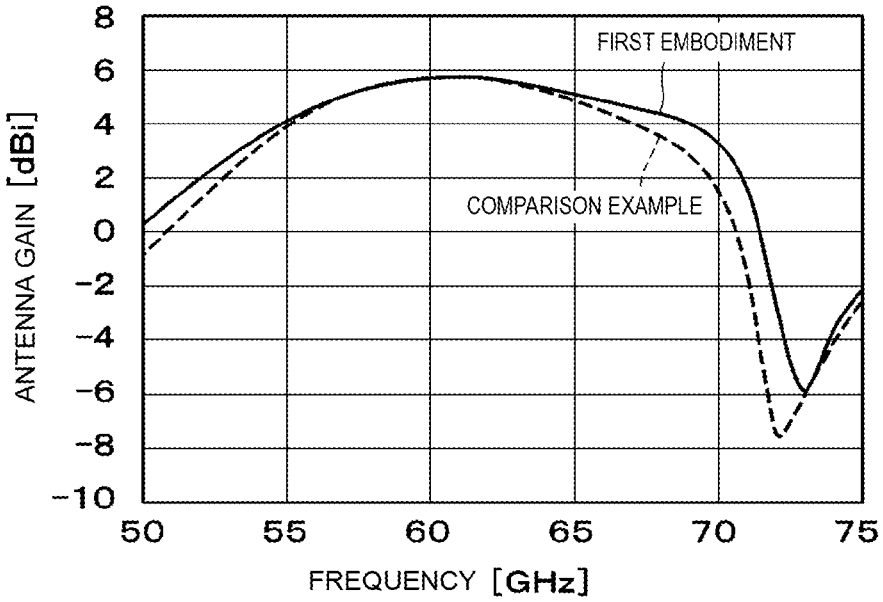
FIG. 7 is a characteristic diagram illustrating frequency characteristics of an antenna gain in the first embodiment and a comparative example.
Figure 8:
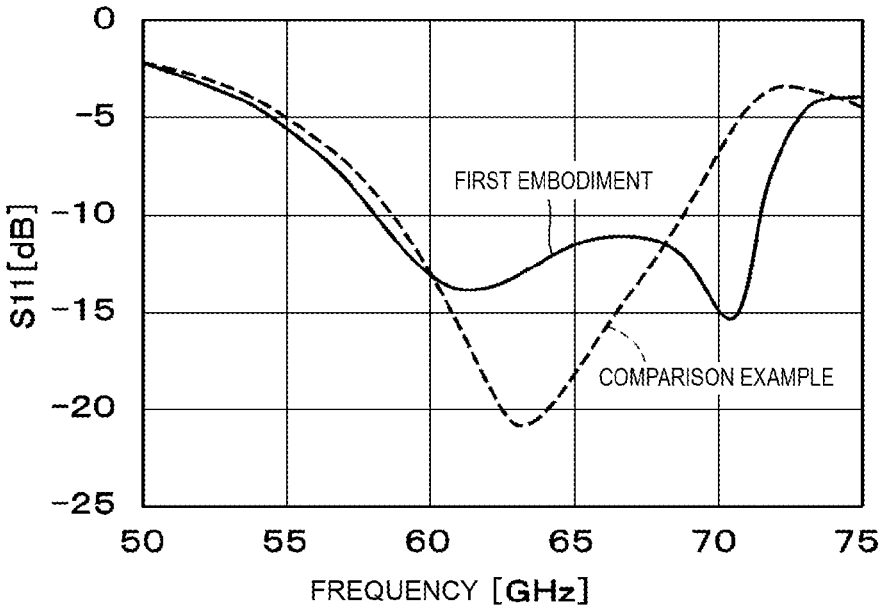
FIG. 8 is a characteristic diagram illustrating frequency characteristics of return loss in the first embodiment and the comparative example.

In order to check an effect by the passive element 16, frequency characteristics of an antenna gain and the return loss were measured in the case (first embodiment) where the passive element 16 was formed in a cross shape and the case (comparison example) where the passive element 16 was formed in a square shape. The results thereof are illustrated in FIG. 7 and FIG. 8. It should be noted that relative dielectric constants $\in r$ of the insulating layers 3 to 5 of the multilayer substrate 2 were set to 3.5, the thickness dimension of the insulating layer 3 was set to 0.1 mm, the thickness dimension of the insulating layer 4 was set to 0.2 mm, and the thickness dimension of the insulating layer 5 was set to 0.075 mm. Both of the length dimensions L1 and L2 of the radiating element 13 were set to 1.1 mm. Both of the width dimensions a1 and a2 of the first and second patches 16A and 16B of the passive element 16 were set to 0.5 mm and both of the length dimensions b1 and b2 were set to 1.2 mm. Both of distances q1 and q2 from the end portion of the radiating element 13 to the vias 14 and 15 as power feeding points of the first and second coplanar lines 7 and 9 were set to 0.16 mm. Meanwhile, in the comparison example, the passive element was formed in a square shape with each side having the length dimension of 1.2 mm.

As illustrated in FIG. 7, the antenna gains have substantially the same characteristics in the first embodiment and the comparison example. When compared in a range of the antenna gain that is equal to or higher than 0 dB, the bandwidth is approximately 20 GHz in the comparison example whereas the bandwidth is approximately 22 GHz in the first embodiment. That is, the bandwidth in the first embodiment is made wider than that in the comparison example by approximately 2 GHz.

Meanwhile, as illustrated in FIG. 8, a bandwidth where the return loss is lower than −10 dB is approximately 10 GHz in the comparison example. In contrast, a bandwidth where the return loss is lower than −10 dB is approximately 14 GHz in the first embodiment. This reveals that the bandwidth is widened.

Thus, in the embodiment, the passive element 16 is formed in the shape in which the two patches 16A and 16B intersect with each other, and the two coplanar lines 7 and 9 are connected to the radiating element 13 so as to correspond to the two patches 16A and 16B, respectively. With this configuration, the resonant frequencies can be set based on the length dimensions b1 and b2 of the patches 16A and 16B and the electromagnetic field coupling quantity between the radiating element 13 and the passive element 16 can be adjusted based on the width dimensions a1 and a2 of the patches 16A and 16B so as to widen a bandwidth in which matching of the antenna 1 is ensured. In this case, the currents I1 and I2 in the different directions flow through the radiating element 13 through the two coplanar lines 7 and 9, so that the length dimensions b1 and b2 and the width dimensions a1 and a2 of the intersecting two patches 16A and 16B can be adjusted separately. As a result, the antenna 1 capable of widening the bandwidth and being shared by the two polarized waves can be configured.

The passive element 16 is formed in the cross shape in which the two patches 16A and 16B are orthogonal to each other. Therefore, the two polarized waves can be made orthogonal to each other, thereby enhancing radiation efficiency. Further, the radiating element 13, the passive element 16, and the like can be formed symmetrically in the directions orthogonal to each other. This makes it possible to form the antenna 1 having symmetric directivity in comparison with the case where the above elements are formed as being inclined obliquely.

Further, power is fed to the radiating element 13 using the coplanar lines 7 and 9. With this configuration, power can be fed to the radiating element 13 using the coplanar lines 7 and 9, which are commonly used in high-frequency circuits, whereby the high-frequency circuit and the antenna 1 can be connected easily.

The internal ground layer 11, the radiating element 13, and the passive element 16 are provided in the multilayer substrate 2 formed by laminating the plurality of insulating layers 3 to 5. Therefore, the passive element 16, the radiating element 13, and the internal ground layer 11 are sequentially provided on the upper surfaces of the respective insulating layers 3 to 5, thereby arranging them at positions different from one another in the thickness direction of the multilayer substrate 2 with ease.

In addition, the internal ground layer 11 and the strip conductors 8 and 10 of the coplanar lines 7 and 9 are provided between the insulating layers 4 and 5. Therefore, the coplanar lines 7 and 9 can be formed together in the multilayer substrate 2 in which the internal ground layer 11, the radiating element 13, and the passive element 16 are provided. This makes it possible to improve the productivity and reduce the characteristic variation.

Figure 9:
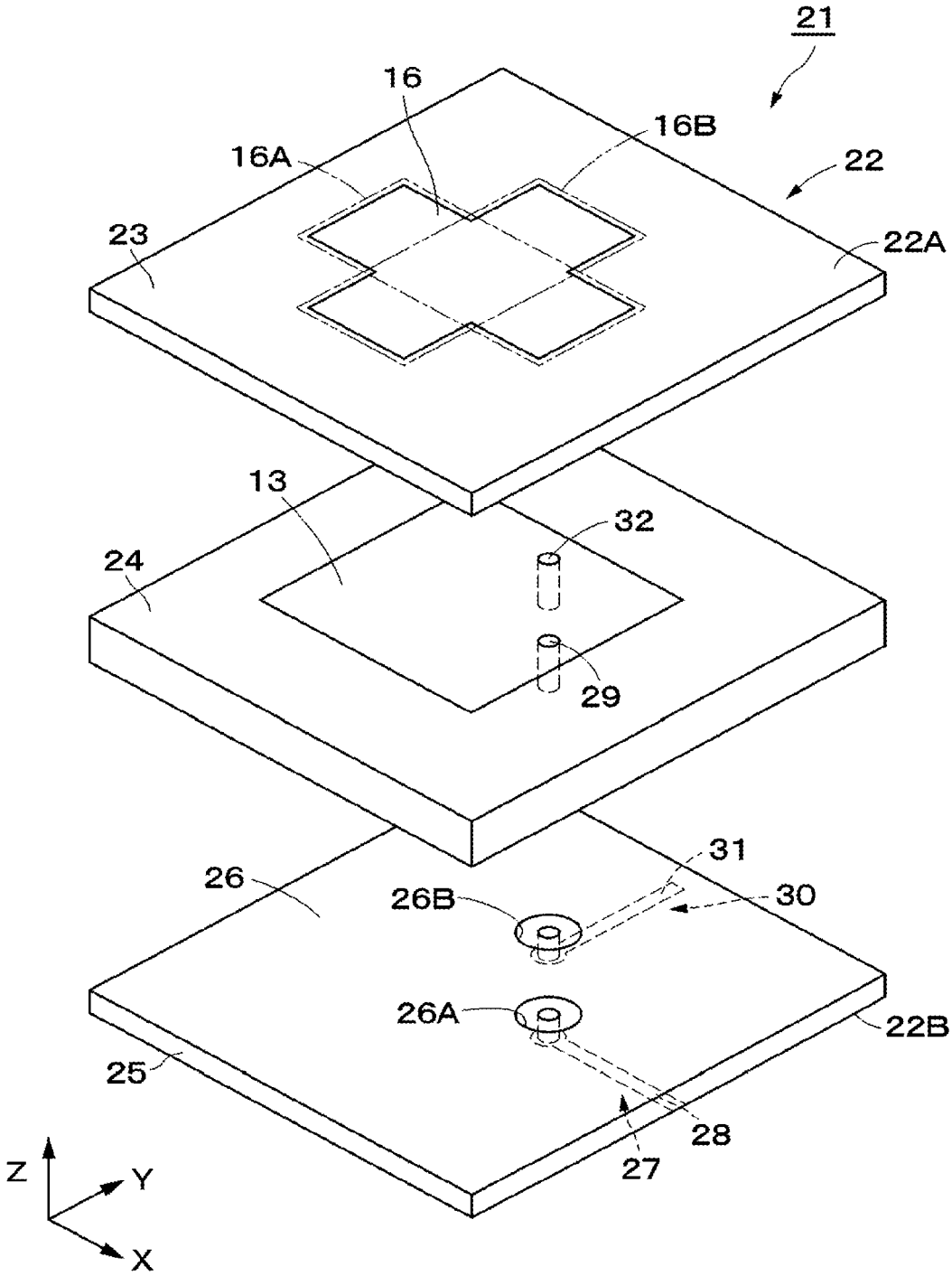
FIG. 9 is an exploded perspective view illustrating a dual-polarized antenna according to a second embodiment.
Figure 10:
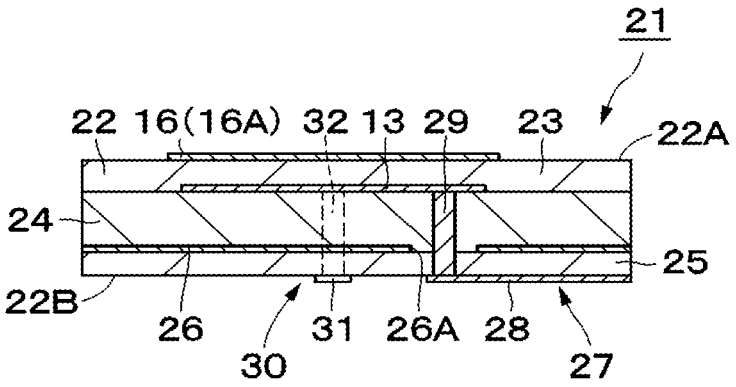
FIG. 10 is a cross-sectional view illustrating the dual-polarized antenna according to the second embodiment at the position same as that in FIG. 3.
Figure 11:
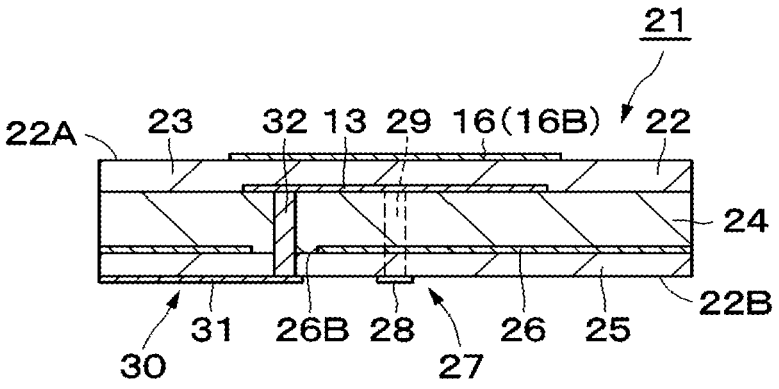
FIG. 11 is a cross-sectional view illustrating the dual-polarized antenna according to the second embodiment at a position same as that in FIG. 4.

Next, FIG. 9 to FIG. 11 illustrate a second embodiment of the invention. The second embodiment is characterized in that a microstrip line is connected to a radiating element. Note that in the second embodiment, the same reference numerals denote the same constituent components as those in the first embodiment and description thereof is omitted.

A dual-polarized antenna 21 in the second embodiment is configured by a multilayer substrate 22, an internal ground layer 26, first and second microstrip lines 27 and 30, the radiating element 13, the passive element 16, and the like. The multilayer substrate 22 is formed by an LTCC multilayer substrate in substantially the same manner as the multilayer substrate 2 in the first embodiment and includes three insulating layers 23 to 25 laminated from the side of an upper surface 22A toward the side of a lower surface 22B in the Z-axis direction.

In this case, the internal ground layer 26 is provided between the insulating layer 24 and the insulating layer 25 and covers substantially the overall surface of the multilayer substrate 22. The radiating element 13 is located between the insulating layer 23 and the insulating layer 24 and is laminated on the upper surface of the internal ground layer 26 through the insulating layer 24. The passive element 16 is located on the upper surface 22A of the multilayer substrate 22 (the upper surface of the insulating layer 23) and is laminated on the upper surface of the radiating element 13 through the insulating layer 23. The passive element 16 is located at the opposite side to the internal ground layer 26 when seen from the radiating element 13 and is insulated from the radiating element 13 and the internal ground layer 26.

As illustrated in FIG. 9 and FIG. 10, the first microstrip line 27 is provided at the opposite side to the radiating element 13 when seen from the internal ground layer 26 and configures a feeding line for feeding power to the radiating element 13. To be specific, the microstrip line 27 is configured by the internal ground layer 26 and a strip conductor 28 provided at the side opposite to the radiating element 13 when seen from the internal ground layer 26. The strip conductor 28 is made of the conductive metal material that is the same as that of the internal ground layer 26, for example, and is formed in an elongated band shape extending in the X-axis direction. The strip conductor 28 is provided on the lower surface 22B of the multilayer substrate 22 (the lower surface of the insulating layer 25).

An end portion of the strip conductor 28 is arranged at a center portion of a connection opening 26A formed in the internal ground layer 26 and is connected to an intermediate position of the radiating element 13 in the X-axis direction through a via 29 as a connecting line. With this, the first microstrip line 27 feeds power to the radiating element 13 in the X-axis direction corresponding to the first patch 16A.

As illustrated in FIG. 9 and FIG. 11, a second microstrip line 30 is also formed by the internal ground layer 26 and a strip conductor 31 and configures a feeding line in substantially the same manner as the first microstrip line 27. The strip conductor 31 is made of the conductive metal material that is the same as that of the internal ground layer 26, for example, and is formed in an elongated band shape extending in the Y-axis direction. The strip conductor 31 is provided on the lower surface 22B of the multilayer substrate 22 (the lower surface of the insulating layer 25). An end portion of the strip conductor 31 is arranged at a center portion of a connection opening 26B formed in the internal ground layer 26 and is connected to an intermediate position of the radiating element 13 in the Y-axis direction through a via 32 as a connecting line. With this, the second microstrip line 30 feeds power to the radiating element 13 in the Y-axis direction corresponding to the second patch 16B.

The vias 29 and 32 are formed in substantially the same manner as the vias 14 and 15 in the first embodiment. Further, the vias 29 and 32 are formed so as to penetrate through the insulating layers 24 and 25 and extend in the Z-axis direction through the center portions of the connection openings 26A and 26B. With this, both the ends of the vias 29 and 32 are connected to the radiating element 13 and the strip conductors 28 and 31, respectively.

The via 29 configures a first connecting line connecting the radiating element 13 to the first microstrip line 27. The via 29 is arranged at substantially the same position as the via 14 in the first embodiment. Further, the via 32 configures a second connecting line connecting the radiating element 13 to the second microstrip line 30. The via 32 is arranged at substantially the same position as the via 15 in the first embodiment.

Thus, the same functions and effects as those in the first embodiment can be also obtained in the second embodiment.

Figure 12:
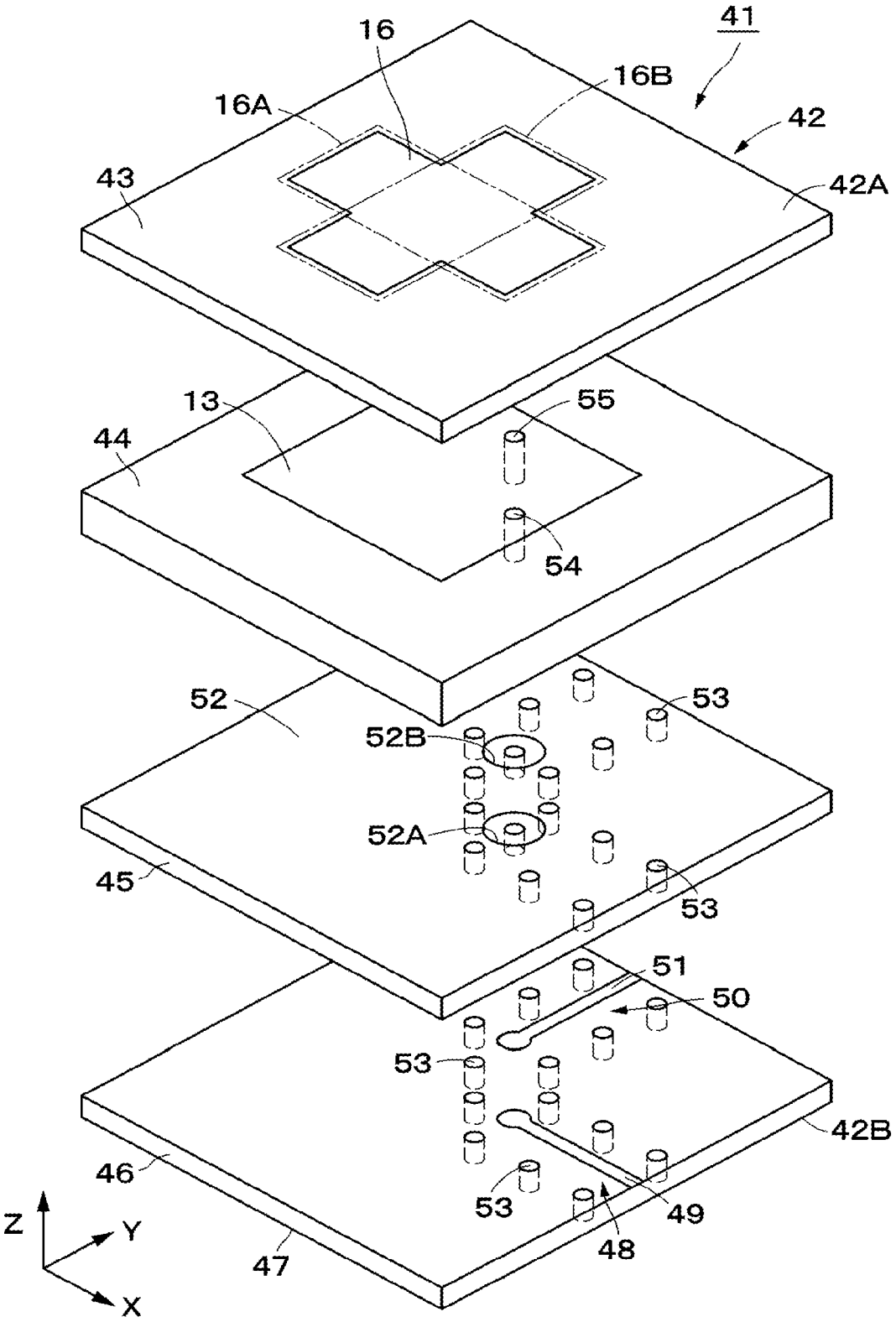
FIG. 12 is an exploded perspective view illustrating a dual-polarized antenna according to a third embodiment.
Figure 13:
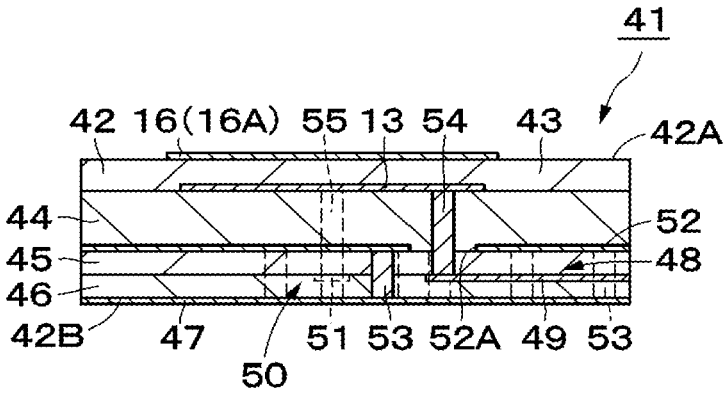
FIG. 13 is a cross-sectional view illustrating the dual-polarized antenna according to the third embodiment at the position same as that in FIG. 3.
Figure 14:
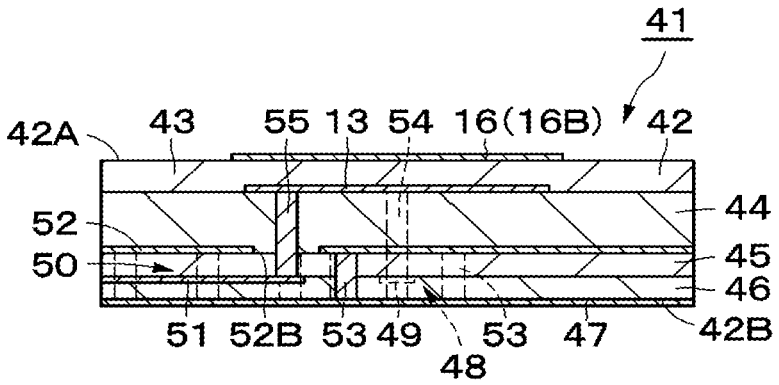
FIG. 14 is a cross-sectional view illustrating the dual-polarized antenna according to the third embodiment at the position same as that in FIG. 4.

Next, FIG. 12 to FIG. 14 illustrate a third embodiment of the invention. The third embodiment is characterized in that a triplate line (strip line) is connected to a radiating element. Note that in the third embodiment, the same reference numerals denote the same constituent components as those in the first embodiment and description thereof is omitted.

A dual-polarized antenna 41 in the third embodiment is configured by a multilayer substrate 42, first and second triplate lines 48 and 50, an internal ground layer 52, the radiating element 13, the passive element 16, and the like. The multilayer substrate 42 is formed by an LTCC multilayer substrate in substantially the same manner as the multilayer substrate 2 in the first embodiment and includes four insulating layers 43 to 46 laminated from the side of an upper surface 42A toward the side of a lower surface 42B in the Z-axis direction.

In this case, the radiating element 13 is located between the insulating layer 43 and the insulating layer 44 and is laminated on the upper surface of the internal ground layer 52, which will be described later, through the insulating layer 44. The passive element 16 is located on the upper surface 42A of the multilayer substrate 42 (the upper surface of the insulating layer 43) and is laminated on the upper surface of the radiation element 13 through the insulating layer 43. The passive element 16 is located at the opposite side to the internal ground layer 52 when seen from the radiation element 13 and is insulated from the radiation element 13 and the internal ground layer 52.

A lower-surface portion ground layer 47 is formed by a thin film made of a conductive metal such as copper, silver, or the like, for example, and is connected to the ground. The lower-surface portion ground layer 47 is located on the lower surface 42B of the multilayer substrate 42 and covers substantially the overall surface of the multilayer substrate 42.

The first triplate line 48 configures a feeding line for feeding power to the radiating element 13. The triplate line 48 is configured by a strip conductor 49, as a conductor pattern provided between the insulating layer 45 and the insulating layer 46, the lower-surface portion ground layer 47, and the internal ground layer 52, which will be described later. Note that the strip conductor 49 is interposed between the lower-surface portion ground layer 47 and the internal ground layer 52 in the thickness direction (the Z-axis direction). The strip conductor 49 is made of the conductive metal material that is the same as that of the lower-surface portion ground layer 47, for example, and is formed in an elongated band shape extending in the X-axis direction. Further, the leading end of the strip conductor 49 is connected to an intermediate position of the radiating element 13 between the center portion and a position of an end portion in the X-axis direction. With this, the first triplate line 48 feeds power to the radiating element 13 in the X-axis direction corresponding to the first patch 16A.

The second triplate line 50 configures a feeding line for feeding power to the radiating element 13. In substantially the same manner as the first triplate line 48, the second triplate line 50 is configured by a strip conductor 51 provided between the insulating layer 45 and the insulating layer 46, the lower-surface portion ground layer 47, and the internal ground layer 52. Note that the strip conductor 51 is interposed between the lower-surface portion ground layer 47 and the internal ground layer 52 in the thickness direction (the Z-axis direction). The strip conductor 51 is made of the conductive metal material that is the same as that of the lower-surface portion ground layer 47, for example, and is formed in an elongated band shape extending in the Y-axis direction. Further, the leading end of the strip conductor 51 is connected to an intermediate position of the radiating element 13 between the center portion and a position of an end portion in the Y-axis direction. With this, the second triplate line 50 feeds power to the radiating element 13 in the Y-axis direction corresponding to the second patch 16B.

The internal ground layer 52 is provided between the insulating layer 44 and the insulating layer 45 and covers substantially the overall surface of the multilayer substrate 42. The internal ground layer 52 is formed by a thin film made of a conductive metal, for example, and is electrically connected to the lower-surface portion ground layer 47 through a plurality of vias 53 penetrating through the insulating layers 45 and 46. In this case, the plurality of vias 53 are arranged so as to surround the strip conductors 49 and 51.

Connection openings 52A and 52B having substantially circular shapes, for example, are formed on the internal ground layer 52 at positions corresponding to end portions of the strip conductors 49 and 51. The end portion of the strip conductor 49 is arranged on a center portion of the connection opening 52A and is connected to an intermediate position of the radiation element 13 in the X-axis direction through a via 54 as the connecting line. Likewise, the end portion of the strip conductor 51 is arranged on a center portion of the connection opening 52B and is connected to an intermediate position of the radiation element 13 in the Y-axis direction through a via 55 as a connecting line.

The vias 54 and 55 are formed in substantially the same manner as the vias 14 and 15 in the first embodiment so as to penetrate through the insulating layers 44 and 45 and extend in the Z-axis direction through the center portions of the connection openings 52A and 52B. With this, both ends of the vias 54 and 55 are connected to the radiating element 13 and the strip conductors 49 and 51, respectively.

The via 54 configures a first connecting line connecting the radiating element 13 to the first triplate line 48. The via 54 is arranged at substantially the same position as the via 14 in the first embodiment. Further, the via 55 configures a second connecting line connecting the radiating element 13 to the second triplate line 50. The via 55 is arranged at substantially the same position as the via 15 in the first embodiment.

Thus, the same effects as those in the first embodiment can be also obtained in the third embodiment.

Figure 15:
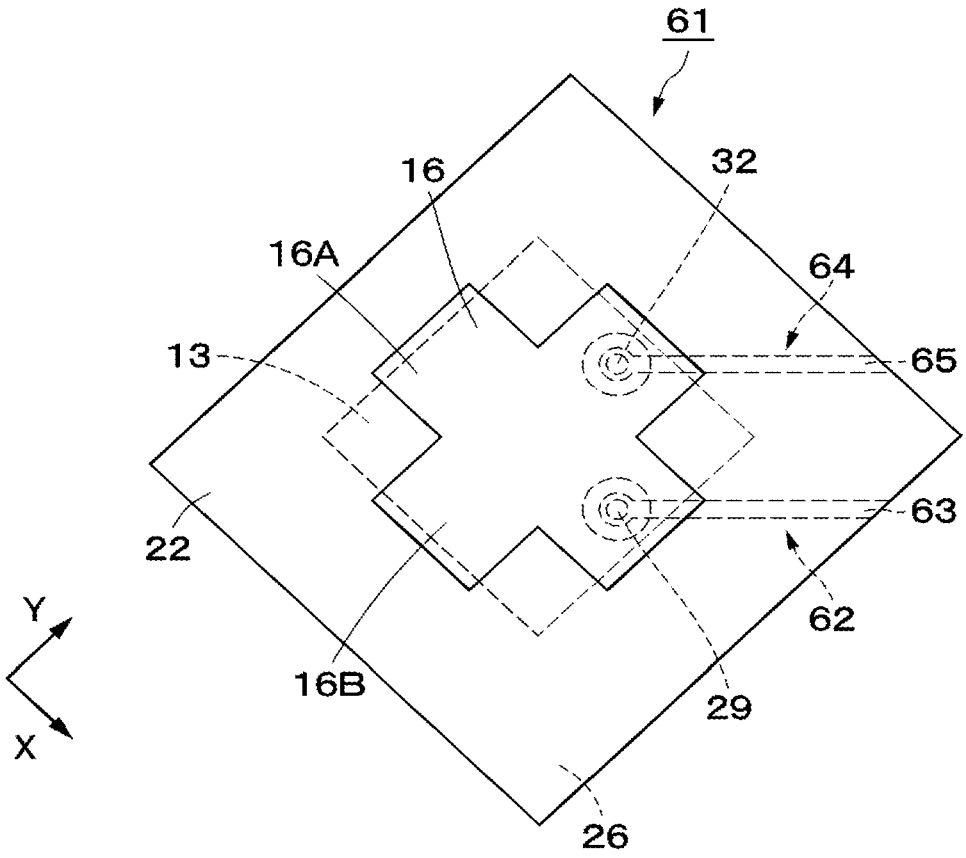
FIG. 15 is a plan view illustrating a dual-polarized antenna according to a fourth embodiment.

Next, FIG. 15 illustrates a fourth embodiment of the invention. The fourth embodiment is characterized in that two microstrip lines are configured to extend in parallel with each other. Note that in the fourth embodiment, the same reference numerals denote the same constituent components as those in the second embodiment and description thereof is omitted.

A dual-polarized antenna 61 in the fourth embodiment is formed in substantially the same manner as the dual-polarized antenna 21 in the second embodiment. The dual-polarized antenna 61 is configured by the multilayer substrate 22, the internal ground layer 26, first and second microstrip lines 62 and 64, the radiating element 13, the passive element 16, and the like.

Note that a strip conductor 63 of the first microstrip line 62 extends in the direction inclined obliquely between the X-axis direction and the Y-axis direction and is inclined with respect to the X-axis direction by 45°, for example. On the other hand, a strip conductor 65 of the second microstrip line 64 extends in the direction inclined obliquely between the X-axis direction and the Y-axis direction and is inclined with respect to the Y-axis direction by 45°, for example. With this configuration, the first and second microstrip lines 62 and 64 extend in parallel with each other.

The leading end of the strip conductor 63 is connected to the radiating element 13 using the via 29 and the leading end of the strip conductor 65 is connected to the radiating element 13 using the via 32.

Although an example in which the first and second microstrip lines 62 and 64 are inclined with respect to the X-axis direction and the Y-axis direction by 45°, respectively, is given above, the directions can be arbitrarily set as long as they extend in parallel with each other. Note that, however, as the extending directions of the first and second microstrip lines 62 and 64 are inclined relative to the directions of the currents I1 and I2 in the radiating element 13, mismatching of impedance is easily generated between the first and second microstrip lines 62 and 64 and the radiating element 13. In consideration of this point, it is preferable for the first and second microstrip lines 62 and 64 to extend in the intermediate directions between the X-axis direction and the Y-axis direction.

Thus, the same effects as those in the first embodiment and the second embodiment can be also obtained in the fourth embodiment. Further, in the fourth embodiment, the two microstrip lines 62 and 64 are configured to extend in parallel with each other. Therefore, the two microstrip lines 62 and 64 are made to extend in parallel with each other toward a high-frequency circuit (not illustrated) from the antenna 61 so as to connect the antenna 61 and the high-frequency circuit. This can connect the high-frequency circuit and the antenna 61 easily in comparison with the case where the two microstrip lines 62 and 64 extend in different directions.

Although the fourth embodiment has been described using the case where the invention is applied to the dual-polarized antenna 61 which is the same as the dual-polarized antenna in the second embodiment as an example, the invention may also be applied to the dual-polarized antennas 1 and 41 in the first and third embodiments.

Further, although the coplanar lines 7 and 9 connected to the ground, which include the lower-surface portion ground layer 6, are used in the first embodiment, a configuration in which the lower-surface portion ground layer 6 is omitted may be employed.

Although examples in which the coplanar lines 7 and 9, the microstrip lines 27, 30, 62, and 64, and the triplate lines 48 and 50 are used as the feeding lines are cited in the respective embodiments, another feeding line such as a coaxial cable may be used.

Figure 16:
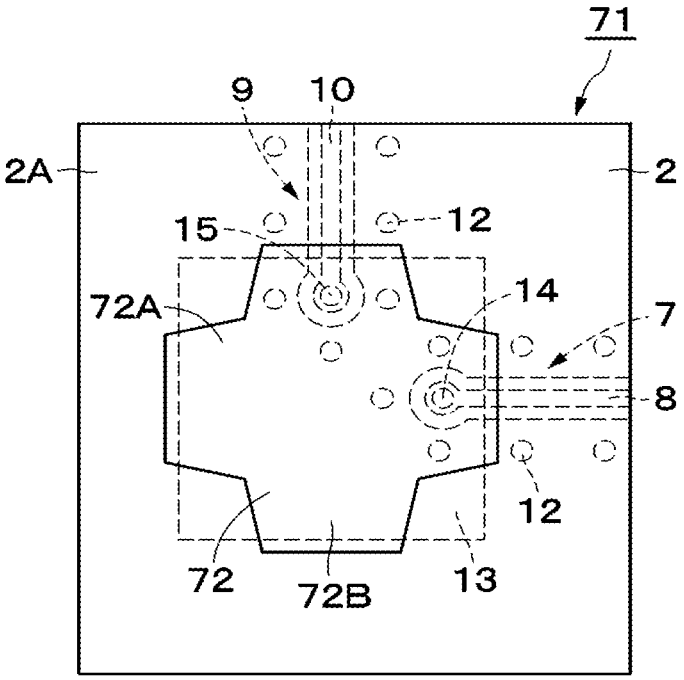
FIG. 16 is a plan view illustrating a dual-polarized antenna according to a first variation.
Figure 17:
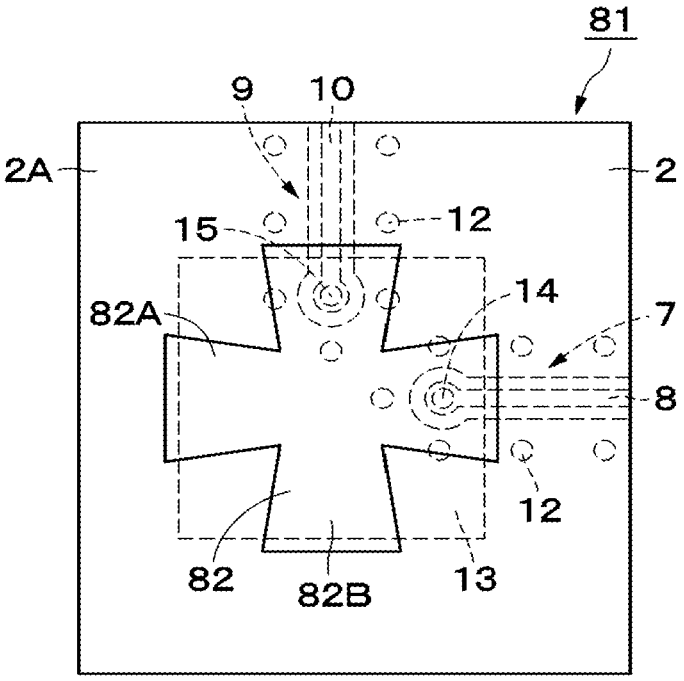
FIG. 17 is a plan view illustrating a dual-polarized antenna according to a second variation.

Further, the passive element 16 has a configuration in which the two patches 16A and 16B having substantially rectangular shapes are orthogonal to each other in the respective embodiments. However, the invention is not limited thereto, and like a dual-polarized antenna 71 according to a first variation as illustrated in FIG. 16, for example, a passive element 72 may have a configuration in which two patches 72A and 72B having width dimensions that are larger at intermediate portions in the lengthwise direction are made orthogonal to each other. Alternatively, like a dual-polarized antenna 81 according to a second variation as illustrated in FIG. 17, for example, a passive element 82 may have a configuration in which two patches 82A and 82B having width dimensions that are smaller at intermediate portions in the lengthwise direction are made orthogonal to each other. Moreover, the two patches are not necessarily orthogonal to each other and may intersect with each other in a state of being inclined obliquely.

In addition, the dual-polarized antennas 1, 21, 41, and 61 that are used for millimeter waves in a band of 60 GHz are employed as examples in the respective embodiments. However, the invention may be applied to dual-polarized antennas that are used for millimeter waves in other frequency bands, microwaves, and the like.

1, 21, 41, 61, 71, 81 DUAL-POLARIZED ANTENNA
2, 22, 42 MULTILAYER SUBSTRATE
6, 47 LOWER-SURFACE PORTION GROUND LAYER
7 FIRST COPLANAR LINE (FIRST FEEDER LINE)
9 SECOND COPLANAR LINE (SECOND FEEDER LINE)
11, 26, 52 INTERNAL GROUND LAYER
13 RADIATING ELEMENT
16, 72, 82 PASSIVE ELEMENT
16A, 72A, 82A FIRST PATCH
16B, 72B, 82B SECOND PATCH
27, 62 FIRST MICROSTRIP LINE (FIRST FEEDER LINE)
30, 64 SECOND MICROSTRIP LINE (SECOND FEEDER LINE)
48 FIRST TRIPLATE LINE (FIRST FEEDER LINE)
50 SECOND TRIPLATE LINE (SECOND FEEDER LINE)

The invention claimed is:

1. A dual-polarized antenna comprising:
an internal ground layer;
a radiating element laminated on an upper surface of the internal ground layer through an insulating layer;
a passive element laminated on an upper surface of the radiating element through an insulating layer, wherein the passive element comprises a first patch and a second patch and the first patch intersects with the second patch, and
a first feeder line for feeding power to the radiating element in a direction corresponding to the first patch and a second feeder line for feeding power to the radiating element in a direction corresponding to the second patch,
wherein the first patch and the second patch are each formed with a substantially rectangular shape having two orthogonal sides,
wherein the dual-polarized antenna is configured by a multilayer substrate formed in a flat plate shape with two plate sides, each extending in a X-axis direction and a Y-axis direction,
wherein one of the two orthogonal sides of the first patch extends in the X-axis direction, and one of the two orthogonal sides of the second patch extends in the Y-axis direction, and
wherein the passive element is integrally formed in a state where center portions of the first patch and the second patch overlap with each other.

2. The dual-polarized antenna according to claim 1,
wherein the passive element has a cross shape in which the first patch and the second patch are orthogonal to each other.

3. The dual-polarized antenna according to claim 1,
wherein each of the first feeder line and the second feeder line comprises a microstrip line, a coplanar line, or a triplanar line.

4. The dual-polarized antenna according to claim 1,
wherein the first feeder line and the second feeder line are both provided on the internal ground layer, and extend in parallel with each other relative to a surface of the internal ground layer.

5. The dual-polarized antenna according to claim 1,
wherein resonant frequencies between the passive element and the radiating element are set based on length dimensions of the first patch and the second patch, and coupling quantity between the passive element and the radiating element is adjusted based on width dimensions of the first patch and the second patch.

6. The dual-polarized antenna according to claim 1, wherein the first feeder line and the second feeder line are provided at a side opposite to the radiating element when seen from the internal ground layer.

7. The dual-polarized antenna according to claim 1, wherein the first feeder line and the second feeder line are configured by the internal ground layer and a strip conductor provided at a side opposite to the radiating element when seen from the internal ground layer.

8. The dual-polarized antenna according to claim 1, wherein when power is fed to the radiating element through the first feeder line, a first current flows through the radiating element in the X-axis direction, and when power is fed to the radiating element through the second feeder line, a second current flows through the radiating element in the Y-axis direction.

9. The dual-polarized antenna according to claim 1, wherein all sides of the first patch and the second patch extend parallel to the X-axis direction or the Y-axis direction, respectively.

10. The dual-polarized antenna according to claim 1, wherein the two orthogonal sides of the first patch and the second patch are each parallel to one of the two plate sides of the flat plate.

* * * * *